United States Patent [19]

Finegan

[11] Patent Number: 4,926,998

[45] Date of Patent: May 22, 1990

[54] COIN SENSER FOR PAY TELEPHONE

[76] Inventor: Jan P. Finegan, 2871 Parkridge Rd., Chamblee, Ga. 30319

[21] Appl. No.: 263,410

[22] Filed: Oct. 27, 1988

[51] Int. Cl.[5] ..... G07D 5/08

[52] U.S. Cl. ..... 194/315; 194/316

[58] Field of Search ..... 194/224, 304, 306, 307, 194/308, 309, 310, 311, 312, 313, 314, 315, 316

[56] References Cited

U.S. PATENT DOCUMENTS 1,254,533 1/1918 Pedersen ..... 194/308

FOREIGN PATENT DOCUMENTS 546694 9/1957 Canada ..... 194/224

*Primary Examiner*—F. J. Bartuska

*Attorney, Agent, or Firm*—James B. Middleton

[57] ABSTRACT

A coin detecting mechanism for pay telephones detects the presence of a coin by causing the coin to complete a circuit between pins, or between one pin and the chute of the coin sorter. A plastic block supports the pins, the plastic block being such as to absorb the energy of falling coins without damage. One form of the invention uses two closely spaced pins that are connected by the presence of a coin, and another form of the invention uses a single pin angled across the chute so the pin and the chute are connected by a coin. The plastic block has a circuit printed thereon for connection of the pins, and a debounce circuit is connected to the printed circuit.

7 Claims, 1 Drawing Sheet

COIN SENSER FOR PAY TELEPHONE

INFORMATION DISCLOSURE STATEMENT

In pay, or coin operated telephones, it is necessary that there be some means to determine how many of what denomination coins have been deposited into the telephone. For this purpose, telephones include a slug rejector, or coin sorter, to separate the various denominations of coins to be delivered to separate chutes. In each chute, then, some means is provided to determine the presence or absence of a coin. Since each chute receives only one denomination of coin, the additional information of how many coins have passed through each cute allows an easy calculation to arrive at the total dollar value deposited.

The prior art coin sensers have normally included solid state equipment for detection of the presence of a coin. One of the most commonly used devices includes a light emitting diode (LED) and a sensor such as a phototransistor. Usually, the LED is chosen to operate in the infrared area to minimize false readings. Other systems utilize Hall-effect switches or the like. It has been found that the use of these solid state sensers is undesirable in that the life is rather short. Realizing that the apparatus is continually bombarded by coins, ranging from relatively light dimes to rather heavy quarters, and such a mechanical beating destroys solid state components. In spite of the constant destruction which requires replacement of the sensing apparatus, the solid state sensers remain the most-used sensing means.

SUMMARY OF THE INVENTION

This invention relates generally to sensing apparatus, and is more particularly concerned with a coin sensing device for use in pay telephones and the like.

The present invention provides a circuit block that receives the coins from the coin sorter, the circuit block including a plurality of pins so arranged that a coin in a coin chute must necessarily engage at least one pin. In one embodiment of the invention, two pins are used, and the coin completes a circuit between the two pins. In another embodiment of the invention, only one pin is used for each chute, and the coin completes a circuit between the pin and the chute itself. In each embodiment, the pin occupies a sufficient portion of the chute that the coin for that chute cannot avoid engaging the pin or pins in such chute.

The pins comprising the sensing mechanism are sufficiently durable that the present invention should remain serviceable for many years. Though the present invention requires use of electronics, the electronics are removed from the area of bombardment by coins so that solid state integrated circuits and the like are not harmed by use of the device.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENTS

Figure 1:
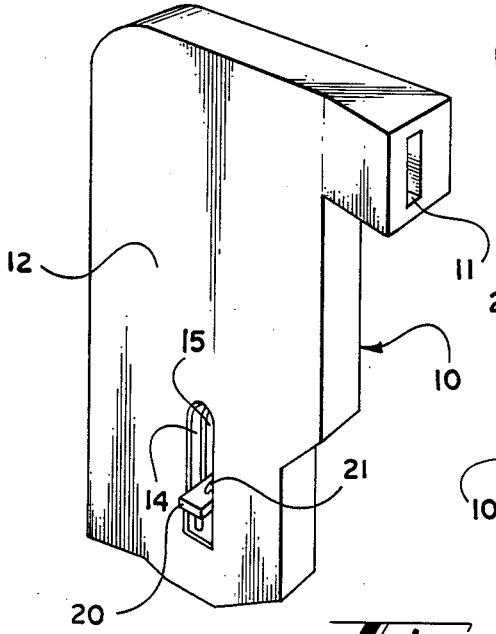
FIG. 1 is a perspective view of a coin sorter for use in pay telephones and the like, the coin sorter having a coin senser made in accordance with the present invention installed therein.

Referring now more particularly to the drawings, and to those embodiments of the invention here presented by way of illustration, FIG. 1 shows a coin sorter generally designated at 10 and having a coin slot 11 for receiving coins to be deposited. The body 12 of the coin sorter 10 includes means for checking the size and weight of coins in order to separate coins by denomination. Such devices usually reject improper deposits, or slugs, at the same time. Such mechanisms are well known in the art, and no detailed description is thought to be necessary.

After the coins are sorted in the body 22 of the mechanism 10, each denomination of coins is directed to one chute such as the chutes 14 and 15. Those skilled in the art will understand that a coin sorter designed to receive four different denominations of coins will have four such chutes, and coin sorters designed to receive different numbers of denominations will have a different number of chutes.

Once the coins are in the chutes such as the chutes 14 and 15, there must be some means for detecting the presence of the coins in order to count the coins and, ultimately, determine the total dollar value of coins deposited. However, it should be realized that the coins are sorted and placed into the individual chutes 14 and 15, and the coins are falling after passing the various sorting mechanisms. It is because of the distance the coins fall that the prior art detecting apparatus is damaged over a period of time. With the present invention, too, the coins fall and engage a block 20 that stops the fall of the coins.

The block 20 of the present invention is preferably made of a plastic material such as nylon, polyolefin, or pehaps high impact polystyrene or the like. The important feature in selecting a plastic is sufficient resilience to prevent fracturing under continual bombardment of the coins. The block 20 extends completely across the body 12, and includes a plurality of pins 21 for engaging the coins. Circuit means 22 connect the pins 21 to a circuit board 24.

Figure 2:
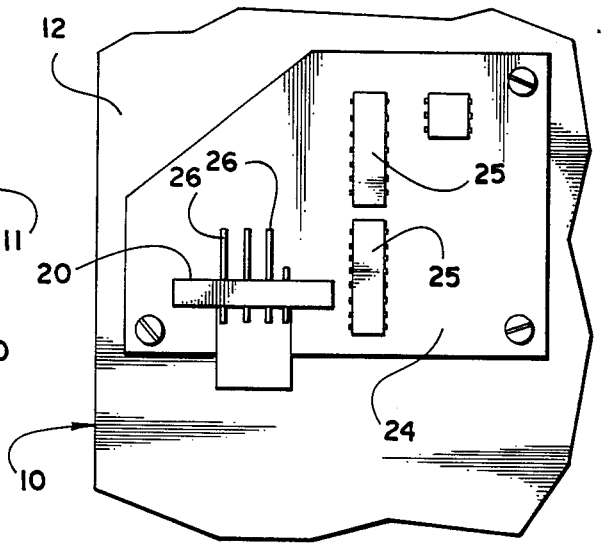
FIG. 2 is an enlarged, fragmentary right side elevational view of the coin sorter shown in FIG. 1, and illustrating the printed circuit control board for the device.

As is shown in FIG. 2 of the drawings, one side of the coin sorter 10 mounts a conventional printed circuit board 24 having a plurality of integrated circuits 25 thereon. The integrated circuits (IC's) are in the form of dual-in-line-packages (DIP) and may comprise any circuitry required. Wires 26 connect the circuit means 22 to the printed circuit board 24.

Figure 3:
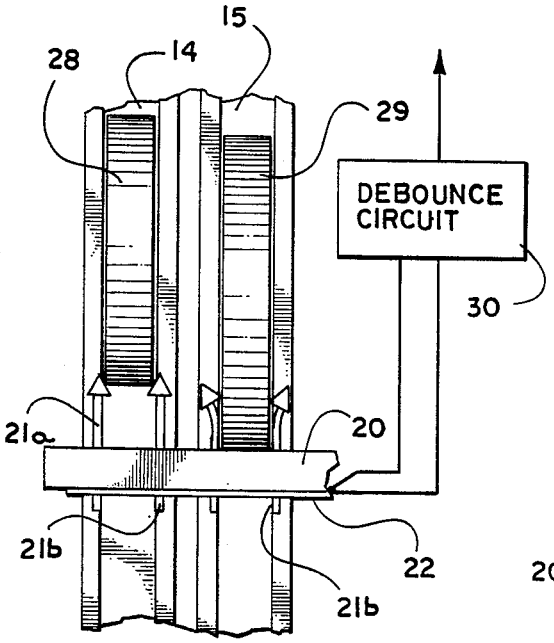
FIG. 3 is an enlarged fragmentary cross-sectional view taken through some of the chutes of the coin sorter and showing the senser of the present invention; and, FIG. 4 is a view similar to FIG. 3 but showing a modified form of senser made in accordance with the present invention.

Looking now at FIG. 3 of the drawings, the block 20 is shown extending across the two chutes 14 and 15. In the embodiment of the invention illustrated in FIG. 3, the pins 21 comprise pairs of pins designated at **21*a* and 21*b*. The electrical arrangement is such that a coin, such as the coins 28 and 29, electrically connect the two pins 21*a* and 21*b* to complete a circuit and allow detection of the coin. In providing for the arrangement it is important that the pins 21*a* and 21*b*** be so located and arranged that a coin will always contact the pins but will never engage the top of either pin, which would cause the coin to bounce upwardly.

To assure that a coin cannot engage the top, or upper end of a pin 21*a* or 21*b*, the pins 21*a* and 21*b* include heads that are generally conical in configuration, the apex of the cone being outside the chute 14 or 15. As a result, only the sloped surface of the head of the pin is presented to the coin. Preferably, the pins 21*a* and 21*b* are so placed that the coin 28 cannot pass between the pins 21*a* and 21*b* while the pins are straight. Rather, the coin 28 will forcefully engage the heads of the pins 21*a* and 21*b* and cause the pins to bend aside and allow the coin to fall. This is illustated with the coin 29, the coin 29 being shown engaging the block 21, and the pins 21*a* nd 21*b* being shown bent outwardly. This assures that the pins 21*a* and 21*b* will engage the coin 29 sufficiently to make a good electrical contact, and absorb some of the energy of the falling coin. The showing in the drawing is exaggerated for ease in understanding.

As before, the block 20 includes circuit means 22 which s connected to various required circuits in the manner shown in FIG. 2. Specifically, the pins 21*a* and 21*b* are connected to a debounce circuit 30. Those skilled in the art will understand that almost any mechanical switch inherently has a certain amount of bounce in making and breaking, and circuits to minimize the electrical effects are well known. The debounce circuit 30 may be any of the well known debounce circuits such as a 555 timer.

Figure 4:
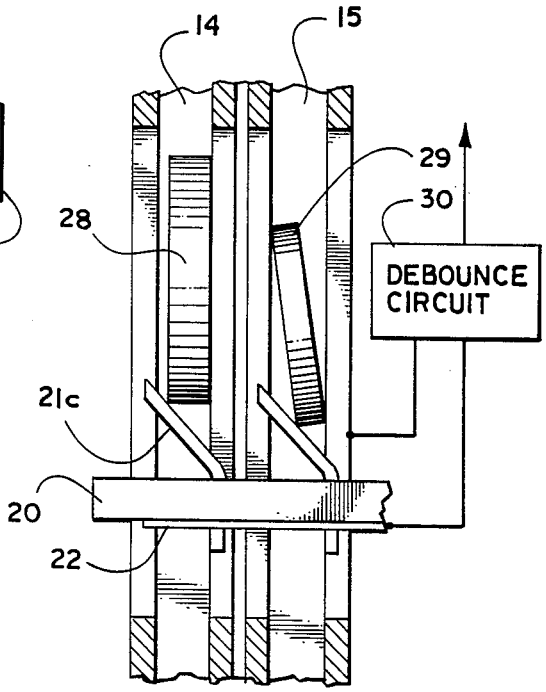

Attention is next directed to the embodiment of the invention shown in FIG. 4 of the drawings. This embodiment is similar to the previous embodiment discussed and the like parts carry the same reference numerals. It will therefore be seen that there are two chutes 14 and 15, and a block 20 having circuit means 22 connected to a debounce circuit 30. Coins 28 and 29 are shown in the chute 14 and 15 engaging the pins 21.

In FIG. 4 of the drawings, the pins 21 are designated as 21*c*. It will be noticed that there is only one pin 21*c* for each chute 14 and 15, the pins 21*c* being angled across the chutes 14 and 15 so that a coin 28 or 29 must necessarily engage the pin 21*c*. As before, it is important that the coin cannot engage the end of the pin 21*c* to cause a pin to bounce up. The extending ends of the pins 21*c* are therefore beyond the chutes 14 and 15, and are in the confines of the walls of the chutes.

Since two electrical contacts are required to complete a circuit, the embodiment of the invention illustrated in FIG. 4 uses the metallic walls of the chutes 14 and 15 as the second contact. The angular disposition of the pins 21*c* insures that the coin 28 or 29 will slide towards the wall of the chute 14 or 15, so the coin will firmly engage both a pin 21*c* and a wall of a chute. The debounce circuit is then connected between the circuit means 22 and the wall of the chute 14 and 15.

It will therefore be understood from the foregoing discussion that the present invention provides a very simple mechanical arrangement for detecting the presence of a coin. The apparatus is not delicate, and can withstand the continual shock of falling coins without damage to the device since the circuit devices are removed from the sensing area. It will of course be realized by those skilled in the art that the particular embodiments of the invention here presented are by way of illustration and are meant to be in no way restrictive; therefore, numerous changes and modifications may be made, and the full use of equivalents resorted to, without departing from the spirit or scope of the invention as outlined in the appended claims.

I claim:

1. Coin detecting apparatus, in combination with a coin sorting device, said coin sorting device including means for receiving coins, means for sorting coins by denomination, and a plurality of chutes, each chute of said plurality of chutes receiving one denomination of coin, said coin detecting apparatus including an integral insulating block extending across said plurality of chutes in a position to be struck by the coins, a plurality of pins fixed to said block and extending upwardly from said block into said chutes, and circuit means carried by said block and electrically connected to said pins, said pins having a sloped portion disposed within said chute for engagement by a coin, and an apex of said pins disposed beyond said chute so that a coin falling within said chute cannot engage said apex.

2. Coin detecting apparatus as claimed in claim 1, said plurality of pins being angled completely across said chutes, said pins being rigidly supported by said block and electrically insulated from said chutes, said pins being electrically connected to said circuit means.

3. Coin detecting apparatus as claimed in claim 2, said circuit means being connected to said plurality of chutes, the arrangement being such that a coin will engage one of said pins and one of said chutes and be electrically detected by completing a circuit through said circuit means.

4. Coin detecting apparatus as claimed in claim 3, and further including a debounce circuit connected to said circuit means.

5. Coin detecting apparatus, in combination with a coin sorting device, said coin sorting device including means for receiving coins, means for sorting coins by denomination, and a plurality of chutes, each chute of said plurality of chutes receiving one denomination of coin, said coin detecting apparatus including a block extending across said plurality of chutes, pin means carried by said block, and circuit means carried by said block and electrically connected to said pin means, said pin means having a sloped portion disposed within said chute for engagement by a coin, and an apex disposed beyond said chute so that a coin falling within said chute cannot engage said apex, said pin means including a pair of pins in each chute of said plurality of chutes, each pin of said pair of pins having a generally conical top for providing said sloped portion disposed within said chute, the pins of said pair of pins being so spaced that a coin in said chute will engage both pins of said

6. Coin detecting apparatus as claimed in claim 5, wherein said conical tops of said pins constitutes a head for said pin, said head for said pin being larger than the shank of said pin, the arrangement being such that a coin will urge said pins apart so that the coin is forcefully engaged by said heads of said pins.

7. Coin detecting apparatus as claimed in claim 6, and further including a debounce circuit connected to said circuit means.

* * * * *